US007114418B1

(12) United States Patent
Allen

(10) Patent No.: US 7,114,418 B1
(45) Date of Patent: Oct. 3, 2006

(54) FAUCET-SEAT TOOL

(76) Inventor: William G. Allen, P.O. Box 503056, San Diego, CA (US) 92150

( * ) Notice: Subject to any disclaimer, the term of this patent is extended or adjusted under 35 U.S.C. 154(b) by 0 days.

(21) Appl. No.: 10/942,194

(22) Filed: Sep. 16, 2004

(51) Int. Cl.
*B25B 23/00* (2006.01)

(52) U.S. Cl. ..... 81/439; 81/177.2

(58) Field of Classification Search ..... 81/439, 81/461, 177.2, 176.15
See application file for complete search history.

(56) References Cited

U.S. PATENT DOCUMENTS

| | | | | |
|---|---|---|---|---|
| 2,564,196 | A | 8/1951 | Denzler | 10/141 |
| 2,592,978 | A | 4/1952 | Trimboli | 145/64 |
| 2,649,825 | A | 4/1953 | Fisher | 81/125 |
| 2,735,325 | A | 2/1956 | Rudd | 81/71 |
| 2,822,714 | A | 2/1958 | Paparelli | 81/71 |
| 3,127,798 | A | 4/1964 | Gol | 81/71 |
| 3,289,503 | A | 12/1966 | Klatt | 81/71 |
| 3,861,251 | A * | 1/1975 | Streander | 81/439 |
| 4,212,336 | A | 7/1980 | Smith | 145/61 |
| 4,279,314 | A * | 7/1981 | Taub | 173/216 |
| D375,028 | S | 10/1996 | Moses | D8/29 |
| 5,568,757 | A * | 10/1996 | Lewis | 81/177.2 |
| 5,586,571 | A | 12/1996 | Guillermo | 137/315 |
| 5,943,924 | A | 8/1999 | Jarvis | 81/177.2 |
| 6,269,717 | B1 * | 8/2001 | Bollinger | 81/177.2 |
| 6,367,356 | B1 * | 4/2002 | Stepp | 81/177.2 |
| D475,589 | S | 6/2003 | Wilkinson | D8/29 |
| 6,748,828 | B1 * | 6/2004 | Bollinger | 81/177.2 |
| 6,813,978 | B1 * | 11/2004 | Karpp | 81/437 |

* cited by examiner

*Primary Examiner*—David B. Thomas
(74) *Attorney, Agent, or Firm*—Frank G. Morkunas

(57) ABSTRACT

A faucet-seat tool with a substantially straight elongated shaft having multiple hex-shaped or square-shaped steps on one end of the shaft and having a head on the other end of the shaft which is adapted to receive an external wrench or ratchet socket wrench into a hole having a biased detent inside the head.

6 Claims, 2 Drawing Sheets

FAUCET-SEAT TOOL

CROSS REFERENCES TO RELATED APPLICATIONS

Not applicable.

STATEMENT REGARDING FEDERALLY-SPONSORED RESEARCH OR DEVELOPMENT

None.

BACKGROUND OF THE INVENTION

This present invention relates to an improvement in a faucet-seat removal tool. Faucet seats are small washer-like structures threaded into water-line housings. A faucet stem also threads into such housings. The end of a faucet stem has a washer which, when the faucet stem in rotated in a clockwise manner, moves the washer onto the seat and, when ultimately the washer and seat are mated, the water is sealed off and prevented from running through the faucet housing and out its spout. Over time, the washers can wear and not mate well with the faucet seat. The faucet will thereby drip. Generally the washer is replaced with a fresh washer which can mate more securely with the seat.

Over even more time, the seat will wear and washers will require replacing with greater regularity until such time that a new washer can no longer proper mate with the seat and water will continuously drip from the spout. When this occurs, the seat must be replaced. At this time, seats are fairly well fused or frozen to the housing and require significant force and pressure to remove.

Current faucet-tools are generally L-shaped and have at each end a set of three steps. One set is generally square-shaped and the other is hex-shaped. Each step farther from the previous step is smaller. One of the six steps of the prior-art faucet-seat tool will engage a hole in the seat and be turned in a direction to remove the seat. Prior-art tools are difficult to maintain in the hole of a seat in that due to their shape forward pressure on the tool toward the seat is rendered difficult, difficult to turn when mated with a seat, and require multiple removal of the tool from the seat hole due to obstructions in the area of endeavor; i.e., faucet spout, shower handle, or the other faucet stem.

Accordingly, several objects and advantages of my invention are to:

a. minimize interference from physical obstructions when removing a faucet seat;

b. maximize forward pressure on a faucet seat to facilitate its removal;

c. eliminate the necessity of removing a faucet-seat tool from the faucet seat during the removal process of the faucet seat; and d. maximize torque during the removal process of a faucet seat to thereby facilitate its removal.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The above-noted problems, among others, are overcome by the present invention. Briefly stated, the present invention contemplates a faucet-seat tool having a substantially straight elongated shaft with multiple hex-shaped or square-shaped steps on one end of the shaft and a head adapted to receive an external wrench or ratchet socket wrench, powered or manual, on the other end of the shaft.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

For a fuller understanding of the nature and objects of the invention, reference should be had to the following detailed description taken in conjunction with the accompanying drawings in which.

DETAILED DESCRIPTION OF THE INVENTION

Figure 1:
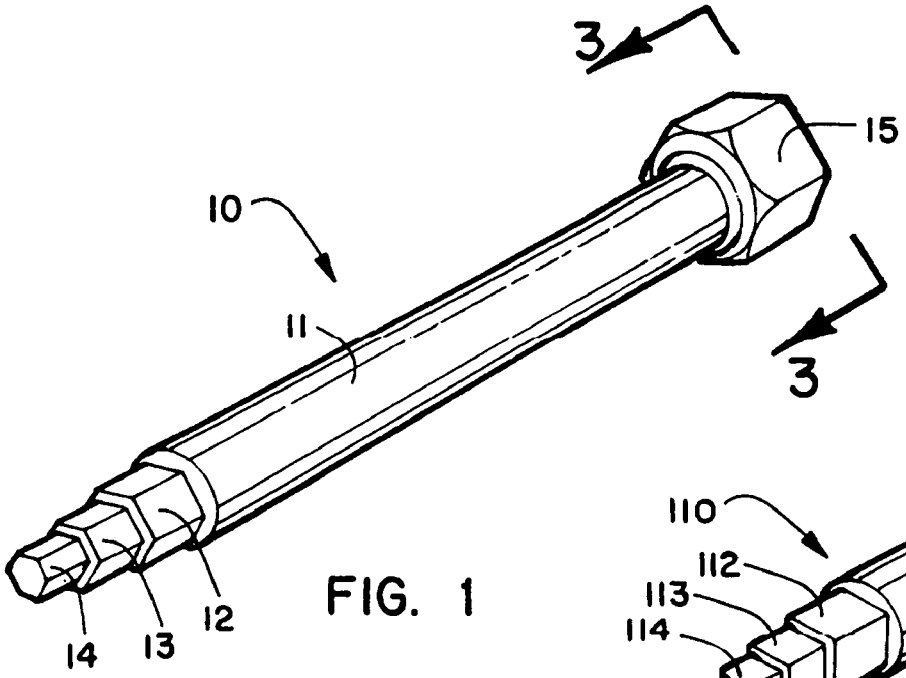
FIG. 1 is a perspective view of one embodiment of the faucet-seat tool.

Referring now to the drawings in detail and in particular to FIG. 1, reference character 10 generally designates a faucet-seat tool constructed in accordance with one preferred embodiment of the present invention. It is a tool used for removing washer seats from water-line housings into which a bath-tub faucet stem is screwed into place.

Figure 5:
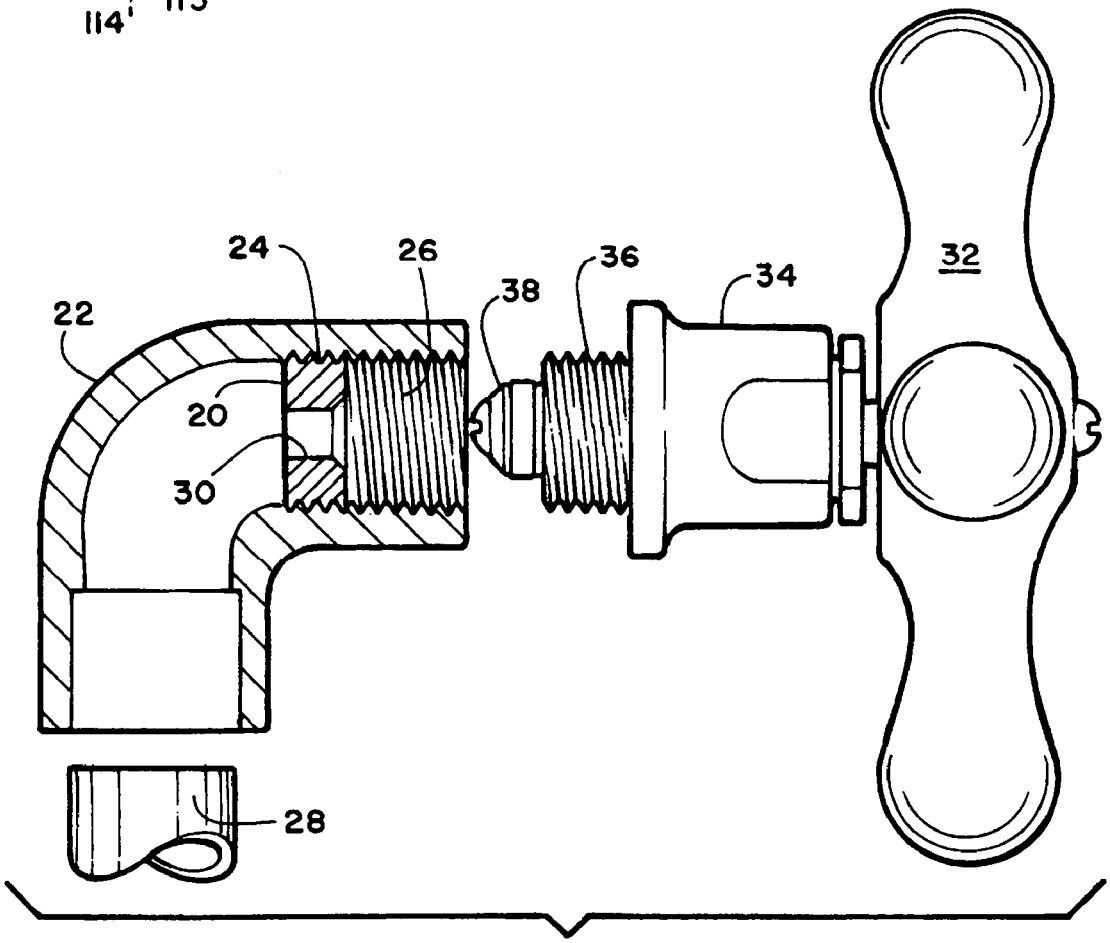
FIG. 5 is detailed cut-away view of a typical faucet-stem and seat-housing arrangement.

Referring to FIG. 5, the seat 20 is the structure which the washer 38 on the bottom [or far end] of the faucet stem 34 presses into when the faucet is turned closed. When the seat 20 gets worn or cracked, the washer 38 no longer presses properly into the seat 20, the faucet leaks, and the seat must be replaced. Seats 20 have a square or hex opening 30 in them into which a seat-removing tool having a corresponding square or hex shaft inserts.

Figure 4:
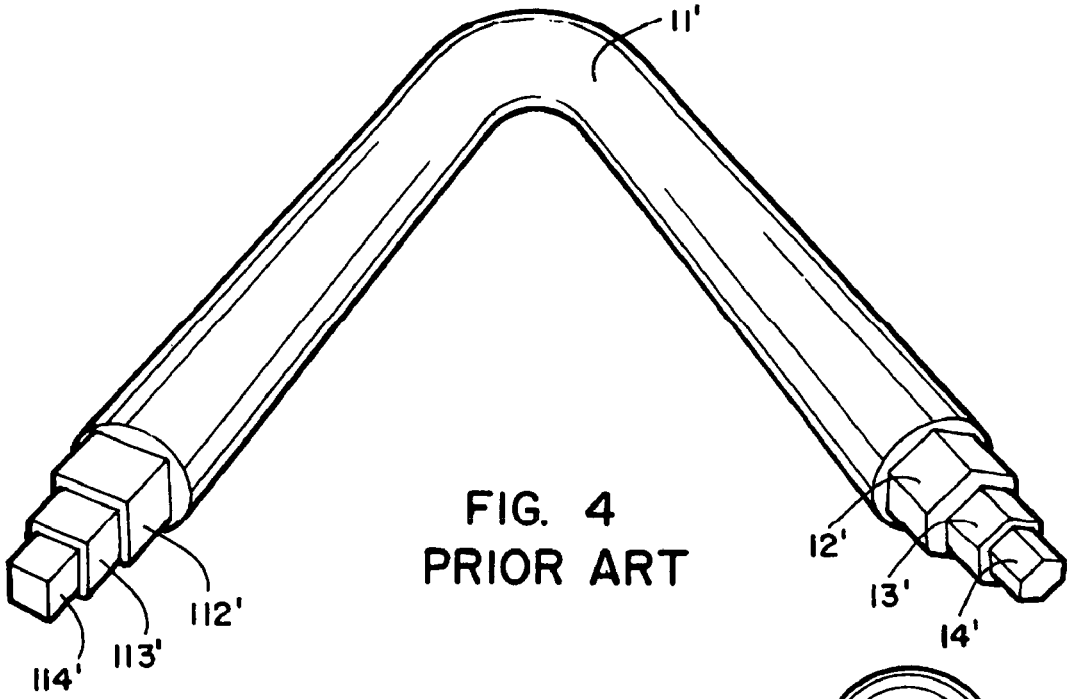
FIG. 4 PRIOR ART
FIG. 4 is a prior-art faucet-seat tool.

FIG. 4 is a typical prior-art seat-removing tool 11'. It typically is L-shaped and has at one end, three hex-shaped steps 12', 13', 14', and at the other end has three square-shaped steps 112', 113', 114'. The farther away each step is from the shaft 11 of the tool, the smaller its size. The three steps are sufficient to accommodate and fit into most seats 20. After the tool inserted into the seat 20, it is turned in the direction necessary to remove [unscrew] the seat 20 from its housing 22. Other prior-art tools have tapering hex or square shapes at their ends.

It is typically difficult to engage the seat opening 30 with either type of prior-art tool, and once engaged, the user must exert significant forward-pressure [in the direction of the seat 20] to keep the originally engaged step 12', 13', 14', 112', 113', 114' in the hole 30. It is difficult to maintain such pressure when using a prior-art L-shaped hand tool. Most seats 20 have been in their respective housing 22 for a significant period of time. As a result, the seat 20 can virtually be 'frozen' to its housing and a great deal of turning force must be applied to 'break' [begin the turning process of] the seat 20 from the housing 22. The amount of torque necessary to break a stubborn seat is substantial and not easily attained with a prior-art L-shaped hand tool. The user must apply forward pressure toward the seat 20 while attempting to turn the L-shaped tool counter-clockwise exerting a great deal of force in the process. The shape of the prior-art tool makes it extremely difficult to maintain the pressure and force necessary to remove a seat 20; particularly a stubborn seat 20.

Additionally, various structures in the bath limit the turning radius of the prior-art tool significantly such that the tool must be removed from the seat, turned back, reinserted into the seat opening, and unscrewed slightly again. The process repeats and repeats over and over until finally the seat 20 is removed. Insertion and re-insertion of the tool into the seat is generally not easy or simple. Consequently, the removal of a seat 20, particularly a stubborn seat 20, can be, and generally is, a time-consuming and laborious process. In the process, the hole 30 in the seat 20 may strip rendering the tool useless and the project all the more difficult and costly.

Figure 2:
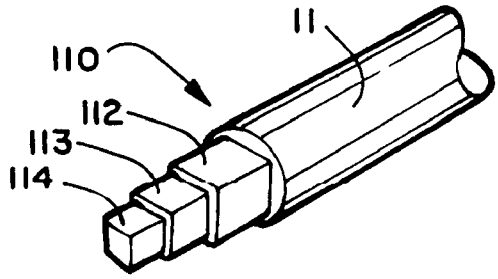
FIG. 2 is a partial view of one embodiment of the faucet-seat tool.
Figure 3:
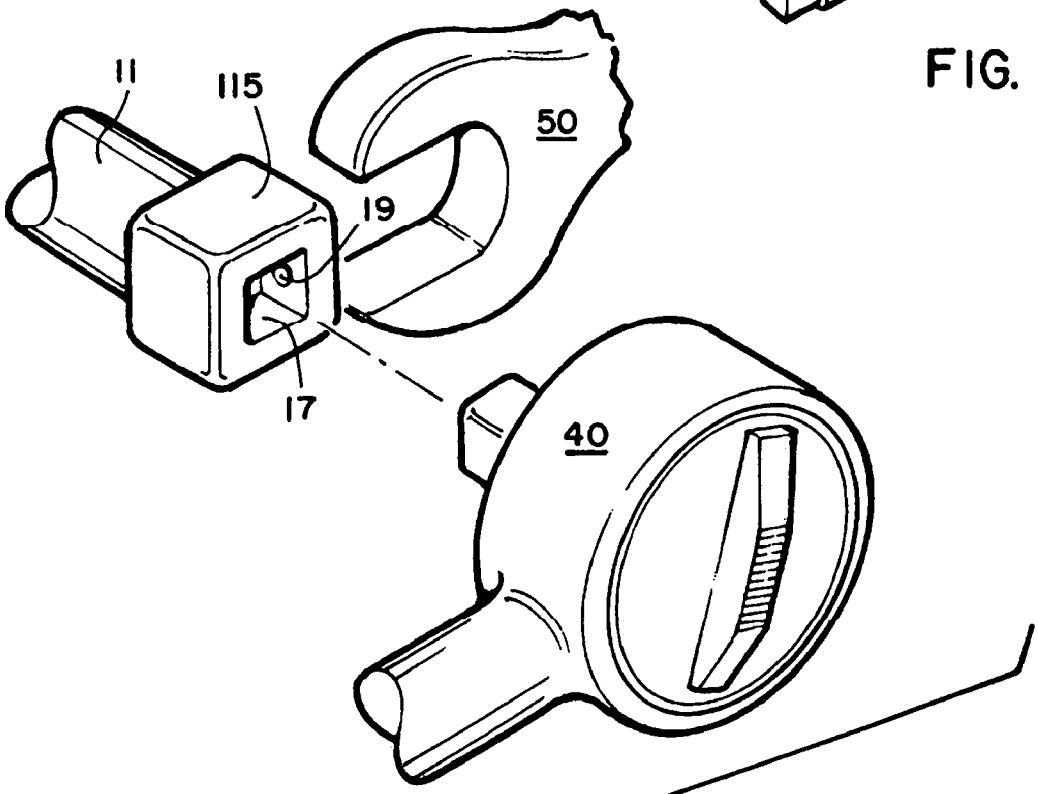
FIG. 3 is a partial view of another embodiment of the head of the faucet-seat tool.

The present invention 10, illustrated in FIGS. 1–3, facilitates the seat's removal. The shaft 11 is relatively straight unlike the prior-art tools. This permits for ease of access by the tool to and into the seat 30. Obstacles, such as the spout or other faucet handles, near the vicinity of the damaged seat 20 have no effect on the use of the present invention.

At one end of the shaft 11 is a head 15 and at the other end of the shaft 11 of this embodiment are three hex-shaped steps of incrementally smaller sizes 12, 13, 14. FIG. 3 shows the head 15 having a square opening 17 into which a ratchet socket wrench 40 may be fitted. One of the three steps 12, 13, 14 is adapted to fit into the opening 30 of the seat 20.

Additionally, the stem 11 is sufficiently long to by-pass any obstacles in the bath which may hinder removal of the seat 20. After the step end of the tool is fitted into the seat 20, the ratchet wrench 40 is pressed into the opening 17 and then the ratchet wrench is rotated in a direction to remove the seat 20. This is all done without having to remove the present-invention tool 10 from the seat 20 or to remove the ratchet socket wrench 40 from the tool 10. Forward pressure is more easily maintained by the user by planning the palm of the user's hand on the back of the head of the ratchet socket wrench 40. Seat removal is simplified thereby. Using a powered ratchet socket wrench, whether pneumatic or electrical, further facilitates application of forward pressure needed to maintain the tool in the seat hole 30 and is capable of applying greater torque as needed to turn out the stubborn seat 20.

FIG. 2 shows the three steps in this embodiment to be square-shaped 112, 113, 114 rather than hex-shaped. The head 15 of the tool 10 also may be hex-shaped 15 [as illustrated in FIG. 1] or square-shaped 115 [as illustrated in FIG. 3] to facilitate use of a box wrench, crescent wrench, adjustable wrench, or open-end wrench 50, or similar tool instead of the ratchet socket wrench 40. Additionally, dimples or detents 19, biased or unbiased, in the opening 17 of the head 15 facilitate securing the ratchet socket wrench in opening 17.

The present disclosure includes that contained in the present claims as well as that of the foregoing description. Although this invention has been described in its preferred forms with a certain degree of particularity, it is understood that the present disclosure of the preferred forms has been made only by way of example and numerous changes in the details of construction and combination and arrangement of parts may be resorted to without departing from the spirit and scope of the invention. Accordingly, the scope of the invention should be determined not by the embodiments illustrated, but by the appended claims and their legal equivalents.

The invention claimed is:

1. A plumbing tool for use in plumbing to remove a faucet seat, said tool comprising:

(a) a substantially straight shaft having a head at one end with four or more flat sides comprising its outer surface wherein said outer surface is adapted to receive an externally applied wrench on said outer surface for the purpose of rotating said faucet-seat tool and at least two hex-shaped or square-shaped steps at the other end adapted to engage a seat of a faucet to facilitate removal of said seat; and (b) an exposed opening in said head adapted to receive a socket wrench and wherein the opening in said head further comprises a detent.

2. The tool of claim 1 wherein said head is square-shaped.

3. The tool of claim 1 wherein said head is hex-shaped.

4. A plumbing tool for use in plumbing to remove a faucet seat, said tool comprising:

(a) a substantially straight shaft having a head at one end and at least two hex-shaped or square-shaped steps at the other end adapted to engage a seat of a faucet to facilitate removal of said seat; and (b) an exposed opening in said head adapted to receive a socket wrench, and within said opening, a detent adapted to apply retaining pressure on an inserted socket wrench.

5. The tool of claim 4 wherein said head is square-shaped.

6. The tool of claim 4 wherein said head is hex-shaped.

* * * * *